US005101899A

United States Patent [19]

Hoskins et al.

[11] Patent Number: 5,101,899

[45] Date of Patent: Apr. 7, 1992

[54] RECOVERY OF PETROLEUM BY ELECTRO-MECHANICAL VIBRATION

[75] Inventors: B. Wayne Hoskins, Grapevine; Henry M. Fiur, Arlington, both of Tex.

[73] Assignee: International Royal & Oil Company, Fort Worth, Tex.

[21] Appl. No.: 663,186

[22] Filed: Feb. 27, 1991

Related U.S. Application Data

[63] Continuation of Ser. No. 450,906, Dec. 14, 1989, abandoned.

[51] Int. Cl.[5] ..... E21B 43/00

[52] U.S. Cl. ..... 166/248; 166/249

[58] Field of Search ..... 367/911, 912; 166/72-73, 104, 248, 249, 369, 373; 175/65

[56] References Cited

U.S. PATENT DOCUMENTS

| | | | |
|---|---|---|---|
| Re. 30,738 | 9/1981 | Bridges et al. . | |
| 1,784,214 | 12/1930 | Workman . | |
| 2,118,669 | 5/1938 | Grebe . | |
| 2,700,422 | 1/1955 | Bodine | 166/249 |
| 3,137,347 | 6/1964 | Parker . | |
| 3,141,099 | 7/1964 | Brandon . | |
| 3,149,672 | 9/1964 | Orkinzewski . | |
| 3,189,088 | 6/1965 | Cronberger . | |
| 3,211,220 | 10/1965 | Sarapuu . | |
| 3,322,196 | 5/1967 | Bodine | 166/249 |
| 3,387,195 | 6/1968 | Piccand et al. . | |
| 3,417,823 | 12/1968 | Faris . | |
| 3,507,330 | 4/1970 | Gill . | |
| 3,530,936 | 9/1970 | Gunderson | 166/248 |
| 3,547,193 | 12/1970 | Gill | 166/248 |
| 3,578,081 | 5/1971 | Bodine | 166/249 |
| 3,585,489 | 6/1971 | Pelly et al. | 321/60 |
| 3,605,888 | 9/1971 | Crowson et al. . | |
| 3,614,986 | 10/1971 | Gill . | |
| 3,620,300 | 11/1971 | Crowson | 166/248 |
| 3,642,066 | 2/1972 | Gill | 166/248 |
| 3,659,168 | 4/1972 | Salihi et al. | 318/227 |
| 3,718,186 | 2/1973 | Brandon | 166/248 |
| 3,766,980 | 10/1973 | Kern | 166/248 |
| 3,849,719 | 11/1974 | Geiersbach et al. | 321/69 R |
| 3,862,662 | 1/1975 | Kern | 166/248 |
| 3,874,450 | 4/1975 | Kern | 166/248 |
| 3,878,312 | 4/1975 | Bergh et al. | 174/9 F |
| 4,010,799 | 3/1977 | Kern et al. | 166/248 |
| 4,013,937 | 3/1977 | Pelly et al. | 321/7 |
| 4,038,592 | 7/1977 | Stummer | 363/165 |
| 4,050,007 | 9/1977 | Gross et al. | 363/87 |
| 4,084,639 | 4/1978 | Todd | 166/248 |
| 4,096,577 | 6/1978 | Schwarz | 363/9 |
| 4,116,273 | 9/1978 | Fisher et al. | 166/248 |
| 4,124,483 | 11/1978 | Christenson | 204/299 |
| 4,140,179 | 2/1979 | Kasevich et al. | 166/248 |
| 4,140,180 | 2/1979 | Bridges et al. | 166/248 |
| 4,196,329 | 4/1980 | Rowland et al. | 219/10.81 |
| 4,199,025 | 4/1980 | Carpenter | 166/248 |
| 4,307,444 | 12/1981 | Stacey et al. | 363/161 |
| 4,376,598 | 3/1983 | Brouns et al. | 405/258 |

OTHER PUBLICATIONS

Main, I. G., 1984, "Vibrations and Waves in Physics", Cambridge Univ. Press, New York, pp. 73-75, 84-86, 262-267.

*Primary Examiner*—Ramon S. Britts
*Assistant Examiner*—Roger J. Schoeppel
*Attorney, Agent, or Firm*—Melvin A. Hunn

[57] ABSTRACT

The production of petroleum from a petroleum bearing formation through an electrically conductive production tubing suspended in a wellbore extending into said formation and lined by an electrically conductive tubular casing is accomplished by a plurality of method steps. A power source of low frequency alternating current is provided. Then, an electrical circuit path is completed, including the production tubing and casing as current paths. The low frequency alternating current is modified by creating transients in it. The modified low frequency alternating current is electrically coupled to the electrical circuit. Mechanical vibration is electrically induced in the casing and production tubing to substantially, continuously, mechanically vibrate the petroleum bearing formation and enhance petroleum production.

30 Claims, 15 Drawing Sheets

U.S. PATENT DOCUMENTS

| | | | |
|---|---|---|---|
| 4,382,469 | 5/1983 | Bell et al. | 166/248 |
| 4,449,585 | 5/1984 | Bridges et al. | 166/248 |
| 4,466,484 | 8/1984 | Kermabon | 166/60 |
| 4,473,114 | 9/1984 | Bell et al. | 166/248 |
| 4,489,782 | 12/1984 | Perkins | 166/248 |
| 4,498,535 | 2/1985 | Bridges | 166/248 |
| 4,524,827 | 6/1985 | Bridges et al. | 166/248 |
| 4,545,435 | 10/1985 | Bridges et al. | 166/248 |
| 4,628,425 | 12/1986 | Venturini et al. | 363/10 |

OTHER PUBLICATIONS

"Encyclopedic Dictionary of Exploration Geophysics", Robert E. Sheriff, pp. 222-223, Soc. Explor. Geophys., Tulsa, Okla.

Wattenbarger, R. A. and F. W. McDougal, "Oil Production Response In Situ Electrical Resistance Heating (ERH)": The Journal of Canadian Petroleum Technology, vol. 27, No. 6, pp. 45-50 (Dec. 1988).

Rintoul, B., 1986, "Electromagnetic Well Stimulation at White Wolf": Pacific Oil World, Oct. 1986, pp. 10-11.

Pizarro, J. O. S. and Trevisan, O. V., "Electrical Heating of Oil Reservoirs: Numerical Simulation and Field Test Results": Journal of Petroleum Technology, vol. 42, No. 10 (Oct. 1990), p. 1320.

Pearce, D. C., W. H. Hulse, Jr. and J. W. Walker, 1972, "The Application of the Therapy of Heterogeneous Dielectrics to Low Surface Area Soil Systems": Geoscience Electronics, vol. GE-11, pp. 167-170.

Kim, E. S., 1987, "Reservoir Simulation of In Situ Electromagnetic Heating of Heavy Oils": Texas A & M University, College Station, Tex., 173 pages (Dissertation).

Keyhani, A. and S. M. Miri, "Nonlinear Modeling of Magnetic Saturation and Hysteresis in an Electromagnetic Device": Electric Power Systems Research, vol. 15, No. 1, pp. 15-23, 1988.

"Revised Thermodynamic Relations for Transitions in Mixtures", P. G. Wright, pp. 1015-1017, J. Phys. A: Gen. Phys., vol. 5, (Jul. 1972).

Fanchi, J. R., "Feasibility of Reservoir Heating by Electromagnetic Irradiation": Soc. of Petroleum Engineers, Paper No. 20483, 1990.

Doublet, L. E., 1988, "Evaluation of Electromagnetic Stimulation of Texas Heavy Oil Reservoirs": M. S. Thesis, Texas A & M University, College Station, Tex.

Delano, J. M. and R. P. Wharton, 1984, "An EPT Interpretation Procedure and Application in Freshwater, Shaly Oil Sands": Journal of Petroleum Technology, Oct. 1984, pp. 1763-1772.

Baylor, B. A., J. B. Maggard, and R. A. Wattenbarger, 1990, "Improved Calculation of Oil Production Response to Electrical Resistance Heating (ERH)": Soc. of Petroleum Engineers, Paper No. 20482.

Bridges, J. E., G. C. Sresty, H. L. Spencer, and R. A. Wattenbarger, 1985, "Electromagnetic Stimulation of Heavy-Oil Wells": in R. F. Meyer, ed., The Third UNITAR/UNDP International Conference on Heavy Crude and Tar Sands, Jul. 22-31, 1985, pp. 615-622.

Briggs, J. E., G. C. Sresty, and H. Dev, 1985, "In Situ RF Heating for Oil Sand and Heavy Oil Deposits": in R. F. Meyer, ed., The Third UNITAR/UNDP International Conference on Heavy Crude and Tar Sands, Jul. 22-31, 1985, pp. 797-804.

Cornelius, C. D., 1985, "Heavy Oil Recovery Methods-A Classification System": in R. F. Meyer, ed., The Third UNITAR/UNDP International Conference on Heavy Crude and Tar Sands, Jul. 22-31, 1985, pp. 943-951.

de Four, M. A., 1985, "Lambda Technology-A New Approach to Improved Heavy Oil Recovery": in R. F. Meyer, ed., The Third UNITAR/UNNDP International Conference on Heavy Crude and Tar Sands, Jul. 22-31, 1985, pp. 623-626.

Buinov, N. S., Yu. I. Bokhan, V. V. Mikhnevich, and S. R. Sirtsov, "Vibronic Ferroelectrics in the Field of a Strong Electromagnetic Wave": Physics Letters, vol. 88A, No. 6, pp. 321-322 (22 Mar. 1872).

Lanotte, L., C. Luponio and F. Porreca, "Spontaneous Vibrational Modes Excited in Ferromagnetics by Reversible Magnetostriction": Journal of Applied Physics, vol. 50, No. 1, pp. 438-443 (Jan. 1979).

Marelco Power Systems, Inc., 1989, "Engineering Solutions' Discussion of Theory and Practice for Transformers, Reactors, and Inductors": Engineering Solutions, Howell, Mich., pp. 2-3.

Oil & Gas Journal, "Electromagnetic Reservoir Stimulation Shows Promise in Brazil": Oil & Gas Journal, vol. 86, No. 46, pp. 106-108 (Nov. 14, 1988).

Sasaki, T., et al., "Magnetostrictive Vibration of Electrical Steel Sheets Under a Non-Sinusoidal Magnetizing Condition", IEEE Transactions on Magnetics, vol. MAG-23, No. 5, pp. 3077-3079 (Sep. 1987).

Shaarawi, A. M. and I. M. Besleris, "Localized Energy Pulse Trains Launched from an Open, Semi-Infinite, Circular Waveguide": Journal of Applied Physics, vol. 65, No. 2, pp. 805-813 (15 Jan. 1989).

39
41
45
37
43
33
25
13
35
27
11
17
21
15
29
23
16
19
31

RECOVERY OF PETROLEUM BY ELECTRO-MECHANICAL VIBRATION

This application is a continuation of application Ser. No. 07/450,906, filed 12/14/89, now abandoned.

BACKGROUND OF THE INVENTION

1. Field of the Invention:

This invention relates generally to systems for enhancing the recovery of petroleum from a petroleum bearing formation, and specifically to systems of enhancing production of petroleum from a petroleum bearing formation through a wellbore by inducing mechanical vibration in the wellbore.

2. Description of the Prior Art:

A variety of approaches have been proposed for enhancing the production of petroleum from a petroleum bearing formation, including fluid and steam injection and flooding, chemical treatment of the petroleum bearing formation, passing electrical currents through the formation to heat the formation with electrical resistance power loss, exposing the petroleum bearing formation to electromagnetic radiation, exposing the petroleum bearing formation to electrical currents and electromagnetic fields to produce electrochemical reactions in the formation, and providing mechanical shocks to the petroleum bearing formation.

Water flooding is one means for secondary recovery of petroleum from a wellbore. It takes advantage of the differences in specific gravity between water and petroleum (the petroleum products have a lower specific gravity than water, usually). A water flood urges the petroleum upward in the formation, making it accessible to one or more wellbores.

Some wells have proven to be more susceptible to treatment with chemical solvents to enhance production. Chemical treatments are well known in the art of secondary recovery, and operate by chemically interacting with the petroleum, making it easier to extract it from the formation.

Steam injection has also been a successful strategy in enhanced recovery, and operates by altering the viscosity of the petroleum in the formation by applying heat. Steam is simply one medium for achieving a heat transfer; other heat transfer media have been used.

More recently, several high-technology approaches for enhancing the recovery of oil from a formation have been proposed, including heating the formation by passing electrical current through it, exciting the formation with electromagnetic radiation, and producing electrochemical reactions in the formation.

The method of passing current into the formation is exemplified by a group of patents, some of which are owned by The Electrothermic Company, of Corpus Christi, Tex.

U.S. Pat. No. 3,507,330, entitled "Method and Apparatus for Secondary Recovery of Oil," discloses a variety of methods for using electrical energy to heat a subterranean formation. This patent teaches the establishment of an electrical circuit from the production tubing of the oil well through the water in the formation. The casing of the oil well is insulated from the tubing, and serves as the return conductor; therefore, the current path between the casing and the tubing is through the formation, and is sufficiently long to provide a desired amount of electrical resistance to the current. Electrical energy which is dissipated in a formation manifests itself as heat which serves to warm the petroleum bearing formation to reduce the viscosity of the petroleum and facilitate recovery.

U.S. Pat. No. 3,547,193, entitled "Method and Apparatus for Recovery of Minerals from Sub-surface Formations Using Electricity," teaches the placement of electrically conductive metal pellets, or collapsible electrodes, into a cavity that has been formed around the borehole in the formation of interest. Current is urged out into the formation, penetrating the formation with heat, and facilitating production of petroleum.

U.S. Pat. No. 4,524,827, entitled "Single Well Stimulation for the Recovery of Liquid Hydrocarbons from Surface Formations," teaches the production of a steam cloud within the formation which does not conduct electrical current, to serve as an electrical insulating barrier, and direct current outward into the formation to maximize the current and heat penetration.

U.S. Pat. No. 3,620,300, entitled "Method and Apparatus for Electrically Heating a Subsurface Formation," discloses the use of electrically insulating shields adjacent the wellbore to deflect the current path out into the formation, and enlarge the area heated by electrical currents.

An alternate approach to the electrical stimulation of petroleum bearing formations is represented by a group of patents, some of which are owned by IIT Research Institute of Chicago, Ill., which focus on exposing an oil bearing formation to electromagnetic radiation to enhance production.

U.S. Pat. No. RE 30,738, entitled "Apparatus and Method for In Situ Heat Processing of Hydrocarbonaceous Formations," discloses the use of radio frequency electrical energy to uniformly heat hydrocarbon bearing formations. In this patent, heating is accomplished by producing an electric field in a subsurface volume defined by a plurality of conductors inserted into the formation.

U.S. Pat. No. 4,449,585, entitled "Apparatus and Method for In Situ Controlled Heat Processing of Hydrocarbonaceous Formations," teaches the production of electric field standing waves in a hydrocarbon formation to effect the dielectric heating of a subsurface formation.

U.S. Pat. No. 4,545,435, entitled "Conduction Heating of Hydrocarbonaceous Formations," teaches the use of relatively low frequency currents coupled with a wave guide structure implanted in the formation to effect heating.

U.S. Pat. No. 4,140,180, entitled "Method for In Situ Heating Processing of Hydrocarbonaceous Formations," discloses the use of alternating electric fields to produce dielectric heating of a subsurface formation. The frequencies employed in this process are in the megahertz range.

U.S. Pat. No. 4,196,329, entitled "Situ Processing of Organic Ore Bodies," discloses the use of alternating current to produce electric fields that are used to differentially heat a body containing hydrocarbon compounds, so that substantial temperature gradients are produced to stress the subsurface formation. Such stress produces conditions which readily fracture the body.

A variety of attempts have also been made to electrochemically induce enhanced production of petroleum. U.S. Pat. No. 3,642,066, entitled "Electrical Method and Apparatus for the Recovery of Oil," discloses a process which combines electroosmosis and electrical heating of a formation penetrated by two wells, to enhance recovery. In this system, oil is drawn to one well, the producing well, and water is drawn to the other well. Two separate electrical circuits are employed; a DC circuit between the wells, and an AC circuit in one well. Oil in the formation will move toward the cathode and water in the formation will move toward the anode. The AC circuit serves to heat the formation.

An alternate electrochemical system is disclosed in U.S. Pat. No. 4,199,025, entitled "Method and Apparatus for Tertiary Recovery of Oil," which discloses the use of a plurality of electrodes in contact with a water electrolyte in the formation. A current flow between the spaced electrodes and through the oil bearing formation is established by means of the electrolyte. A sufficient AC current is provided to produce the disassociation of the water and generate free hydrogen and oxygen. The gases are dissolved into the oil, and alter its viscosity.

Many of the enhanced recovery techniques proposed or in actual use are far too expensive for use in wells which have low production, or which require frequent enhanced recovery treatments. Often, the incremental cost of power supplied to the petroleum bearing formation exceeds the benefit derived. In addition, the downtime associated with many of these procedures is far from insignificant, impairing the cash flow from the oil property.

While a variety of enhanced recovery systems have been proposed and actually employed in the field, very little work has been done in mechanically enhancing the recovery of oil. One primitive method used for enhancing recovery comprises the intermittent production of subsurface explosions, in the general area of the formation. These explosions were accomplished by lowering of dynamite or nitroglycerin down the wellbore. This method is of limited utility, since it can only be used in uncased boreholes, and results in a general deterioration of the wellbore walls. In fact, this method could result in an entire collapse of the wellbore, and loss of the well. Information regarding early use of nitroglycerin in wellbores to enhance production can be found in a paper entitled "Manufacture of Nitroglycerin and Use of High Explosives in Oil and Gas Wells," which was presented at the February 1929 meeting of The Society of Petroleum Engineers in New York City, N.Y., by C. O. Rison, and which is a available through The Society of Petroleum Engineers office in Richardson, Tex.

SUMMARY OF THE INVENTION

It is one object of the present invention to enhance the production of petroleum from a petroleum bearing formation by inducing sustained mechanical vibration in the wellbore.

It is another object of the present invention to enhance the production of petroleum from a petroleum bearing formation by electrically stimulating the wellbore casing and tubing to induce mechanical vibration in the wellbore.

It is yet another object of the present invention to enhance the production of petroleum from a petroleum bearing formation by electrically stimulating the wellbore casing and tubing to induce mechanical vibration, with a relatively low power signal having a large number of electrical transients.

It is still another object of the present invention to enhance the production of petroleum from a petroleum bearing formation by electrically stimulating the wellbore casing and tubing to induce mechanical vibration, with a relatively low power signal created by high speed switching of a standard 60 hertz power signal to produce a large number of transients in the signal.

The foregoing objects are achieved as is now described. The production of petroleum from a petroleum bearing formation through an electrically conductive production tubing suspended in a wellbore extending into said formation and lined by an electrically conductive tubular casing is accomplished by a plurality of method steps. A power source of low frequency alternating current is provided. Then, an electrical circuit path is completed, including the production tubing and casing as current paths. The low frequency alternating current is modified by creating transients in it. The modified low frequency alternating current is electrically coupled to the electrical circuit. Mechanical vibration is electrically induced in the casing and production tubing to substantially, continuously, mechanically vibrate the petroleum bearing formation and enhance petroleum production.

The above as well as additional objects, features, and advantages of the invention will become apparent in the following detailed description.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
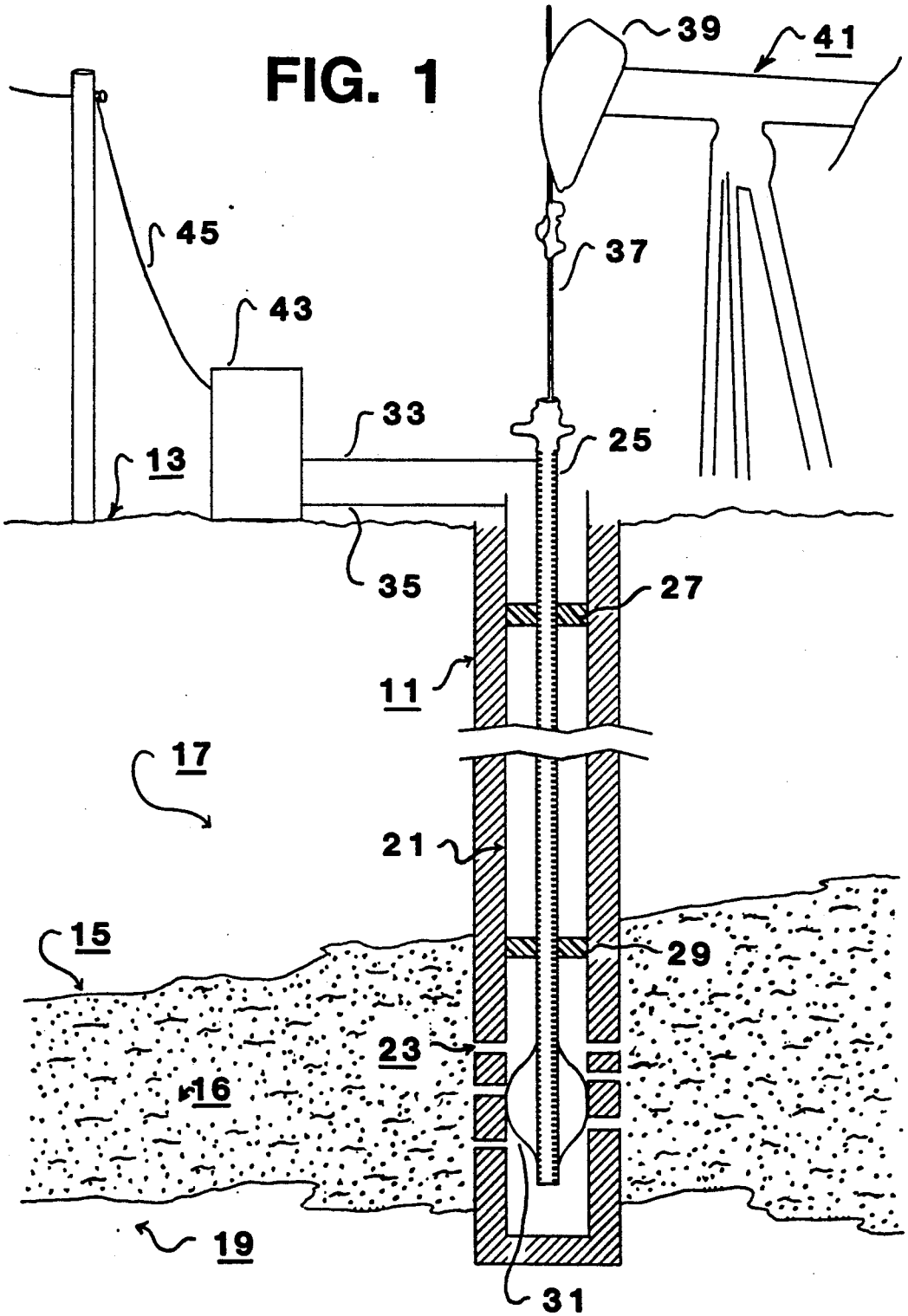
FIG. 1 is a simplified view of a wellbore extending into a petroleum bearing formation, and equipped with a controller.

In FIG. 1, wellbore 11 is depicted extending from surface 13 into petroleum bearing formation 15, which contains petroleum 16. Generally, petroleum bearing formation 15 is a porous formation trapped between nonporous overburden 17 and underburden 19. Casing 21 protects wellbore 11 from deterioration. A plurality of perforations 23 are provided in casing 21 to allow petroleum 16 to flow into wellbore 11 and be pumped to the surface.

Tubing 25 is suspended within casing 21, and is electrically insulated from casing at ten feet intervals by insulators 27, 29, which are constructed of an insulating, non-corrosive material. Contactor 31 is provided in the wellbore to make electrical contact between tubing 25 and casing 21. Polished pump rod 37 is suspended in tubing 25 and coupled through a cable linkage (not depicted) to horse head 39 of walking beam pump 41 to produce petroleum 16 from wellbore 11. The polished pump rod is also electrically insulated from the tubing 25 and casing 21.

Cables 33, 35 couple controller 43 to tubing 25 and Casing 21 of wellbore 11. More specifically, cable 35 electrically couples controller 43 to casing 21, while conductor 33 electrically couples controller 43 to tubing 25. Since tubing 25 and casing 21 are composed of steel, and capable of conducting currents, a closed circuit is established. Current flows from controller 43, through cable 33, into tubing 25. The current descends into the wellbore along the length of tubing 25. Current then flows through contactor 31 into casing 21, and returns to controller 43 via cable 35.

Controller 43 receives single phase power from power line 45, and reconfigures this power signal to produce a power signal with high transient content, which is capable of inducing mechanical vibration in the tubing 25 and casing 21.

Figure 2:
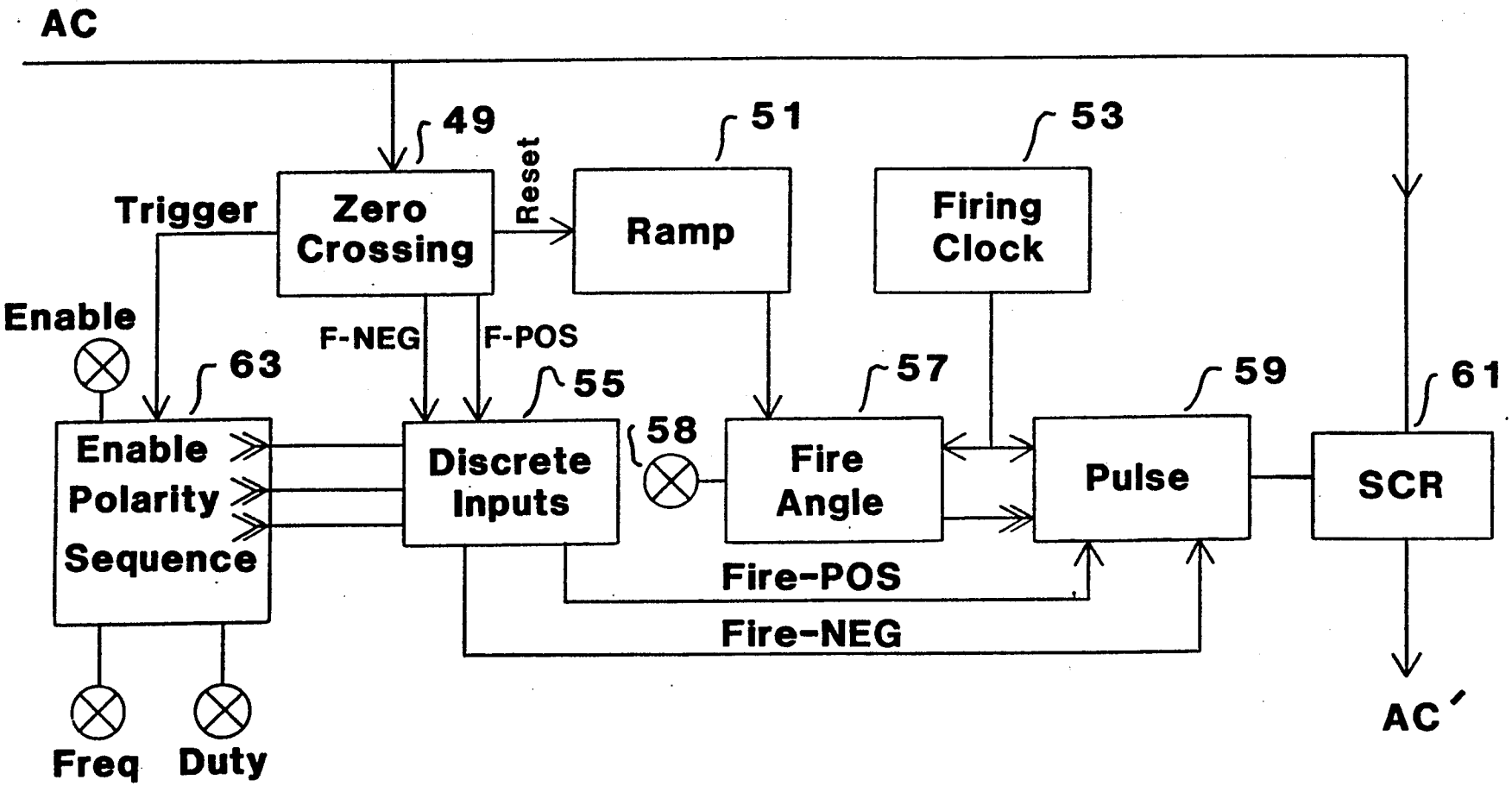
FIG. 2 is a block diagram of the controller.

FIG. 2 is an electrical block diagram of controller 43. As shown, controller 43 includes zero crossing detection circuit 49 which serves to detect the zero crossing of the sinusoidal power signal. The zero crossing detection circuit 49 produces three output signals: a RESET signal, F-NEG, and F-POS. The RESET signal of zero crossing detection circuit 49 is directed to ramp circuit 51. Ramp circuit 51 operates to produce a repeating voltage ramp from zero to ten volts. Each voltage ramp is initiated by the RESET signals from zero crossing detection circuit 49, and consequently are synchronized with the zero crossings of the power signal.

The repeating voltage ramp signals are routed from ramp circuit 51 to fire angle control circuit 57. In this circuit, the RAMP signal is compared to a fixed voltage level which is user selected by voltage control 58. The operator sets the voltage level with voltage control 58 to select a firing angle. The firing angle is defined as the phase difference between the zero crossings of the power signal and a selectable point at which the operator wishes the switching apparatus of silicon controlled rectifier circuit 61 to fire.

The object of controller 43 is to switch the rectified power signal on and off at selected phase angles from the zero crossings. It has been discovered that switching at a large phase angle (or "firing angle") induces large transients in the power signal. Switching at a smaller phase angle induces less transient content in the power signal. In the present application, these transients are desirable. The operator may set the firing, or phase angle, by voltage control 58 to produce a desired transient content in the output signal.

The silicon controlled rectifiers of SCR circuit 61 are driven by fire angle control signal through pulse transformer circuit 59. Four signals are directed to pulse transformer circuit 59: FIRE-CLK, FIRE ANGLE, FIRE-POS, and FIRE-NEG. FIRE-CLK is produced by firing clock circuit 53, and is a 45,000 hertz signal. The FIRE ANGLE signal is a voltage pulse provided by fire angle control circuit 57. FIRE-POS and FIRE-NEG are voltage pulse signal which are provided by discrete control inputs 55.

Discrete control input circuit 55 contains a plurality of logic circuitry blocks which combine three input signals (ENABLE, OFF BOARD POLARITY CONTROL, and FIRE-ON-POS-OR-NEG signals) and produces two output signals: FIRE-POS and FIRE-NEG. The output signals are routed to pulse transformers 59 for digital logic combination with the FIRE-CLK and FIRE ANGLE signals. Basically, a positive voltage on the FIRE-POS line indicates that the silicon controlled rectifiers of SCR circuit 61 should fire to allow the passage of positive components of the power signal. Alternately, a positive voltage on FIRE-NEG directs the silicon controlled rectifiers of SCR 61 to allow the passage of negative components of the power signal.

The inputs to discrete control input circuit 55 include ENABLE, OFF BOARD POLARITY CONTROL, and FIRE-POS-OR-NEG. These signals are provided from sequence circuit 63. Three external controls are provided on sequence circuit 63: ENABLE, FREQUENCY, and DUTY. The ENABLE control simply enables controller 43. The FREQUENCY control allows the operator to select a frequency for the output signal between sixty and six cycles per second. The DUTY control allows the operator to select a duty cycle for the output signal.

A high signal on the FIRE-POS-OR-NEG line directs the discrete control input circuit 55 to produce a high signal on the FIRE-POS. line. Alternately, a low signal on the FIRE-POS-OR-NEG line causes discrete control input circuit 55 to produce a high signal on the FIRE-NEG line.

Figure 3:
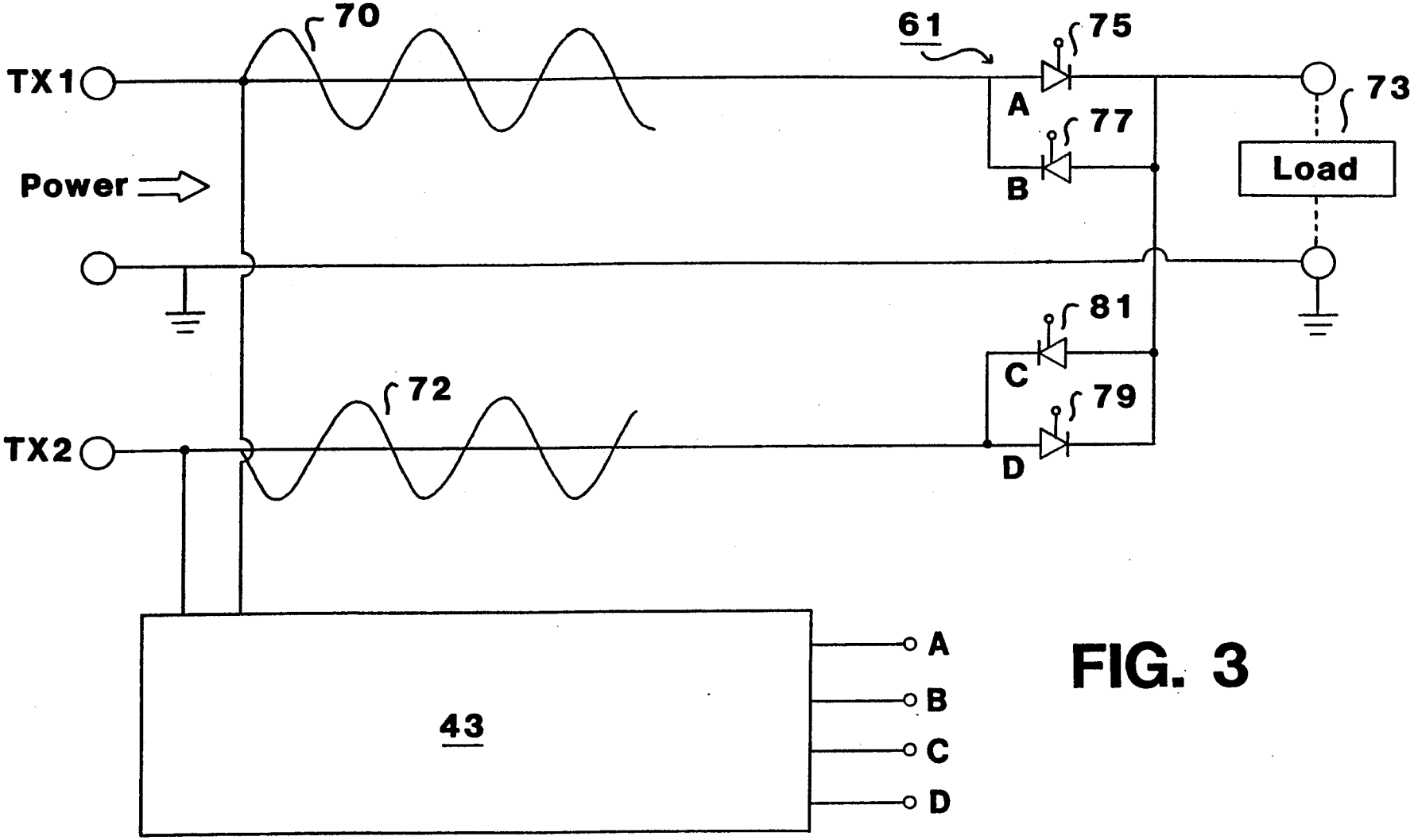
FIG. 3 is a simplified view of the relationship between the incoming electrical lines and the wellbore electrical load.

FIG. 3 depicts the interrelationship of the incoming line TX1, TX2, SCR circuit 61, and load 73. SCR circuit 61 includes four silicon controlled rectifiers 75, 77, 79, and 81. Each silicon controlled rectifier conducts when a positive voltage is applied to both the cathode and gate. Unless positive voltages are present on both the cathode and the gate, the rectifier will not conduct. As shown in FIG. 3, load 73 is connected between silicon controlled rectifier 75, 77, at one terminal, and between silicon controller rectifiers 79, 81 at the other terminal. In this configuration, two of the silicon controlled rectifiers will conduct positive portions of the power signal, and two of the silicon controlled rectifiers will conduct negative portions of the power signal. The firing of silicon controlled rectifiers is controlled by controller 43, which is synchronized with the single phase power supplied by the power signal at terminals TX1, and TX2. One component of the power signal is sinusoidal wave 70. The other component of the power signal is sinusoidal wave 72, which is 90° out of phase from wave 70.

Figure 4:
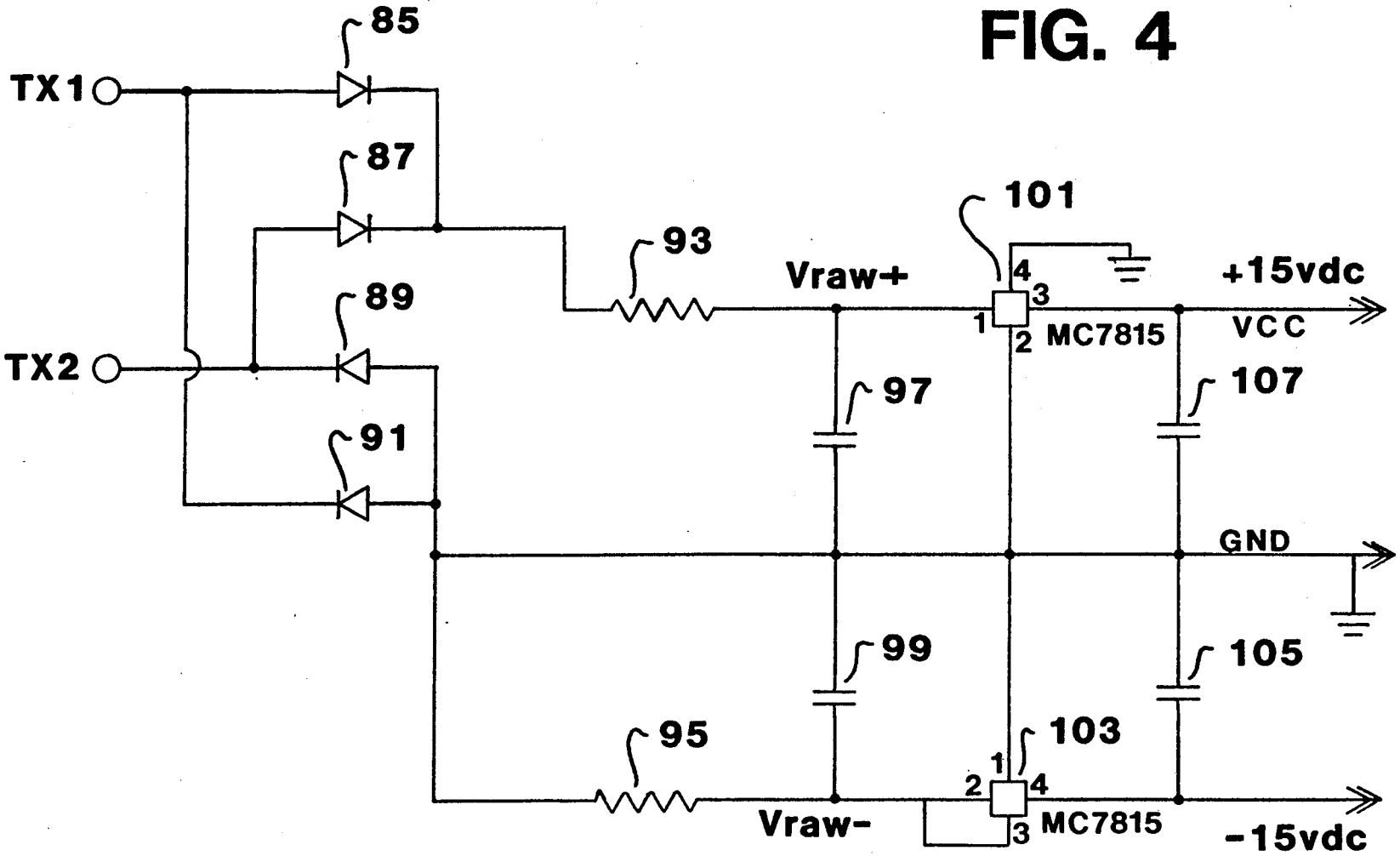
FIG. 4 is an electrical schematic of the power supply circuit of the controller unit.

In FIG. 4, a power supply circuit 83 is depicted in electrical schematic form. The power supply circuit 83 was omitted from the block diagram of FIG. 2 to simplify that figure. Power supply circuit 83 receives power signals from the power transformer leads TX1, TX2. The power signal produced at these leads is a 24 volt alternating current single phase power signal. This power signal is routed through the rectifying circuit which includes diodes 85, 87, 89, and 91. The sinusoidal Wave 70 is filtered by resistor 93 and capacitor 97, and identified as VRAW+. The sinusoidal wave 72 from TX2 is filtered by resistor 95 and capacitor 99 to produce a VRAW−(which actually has a positive voltage level). VRAW+is applied voltage regulator 101, and VRAW−is applied voltage regulator 103. Voltage regulator 101 produces a 15 volt DC signal, identified as VCC. Voltage regulator 103 produce a −15 volt DC signal, which is identified as VEE. The output of voltage regulator 101 is filtered by capacitor 107. The output of voltage regulator 103 is filtered by capacitor 105. The positive and negative 15 volts are used to power the logic circuitry of controller 43.

Figure 5:
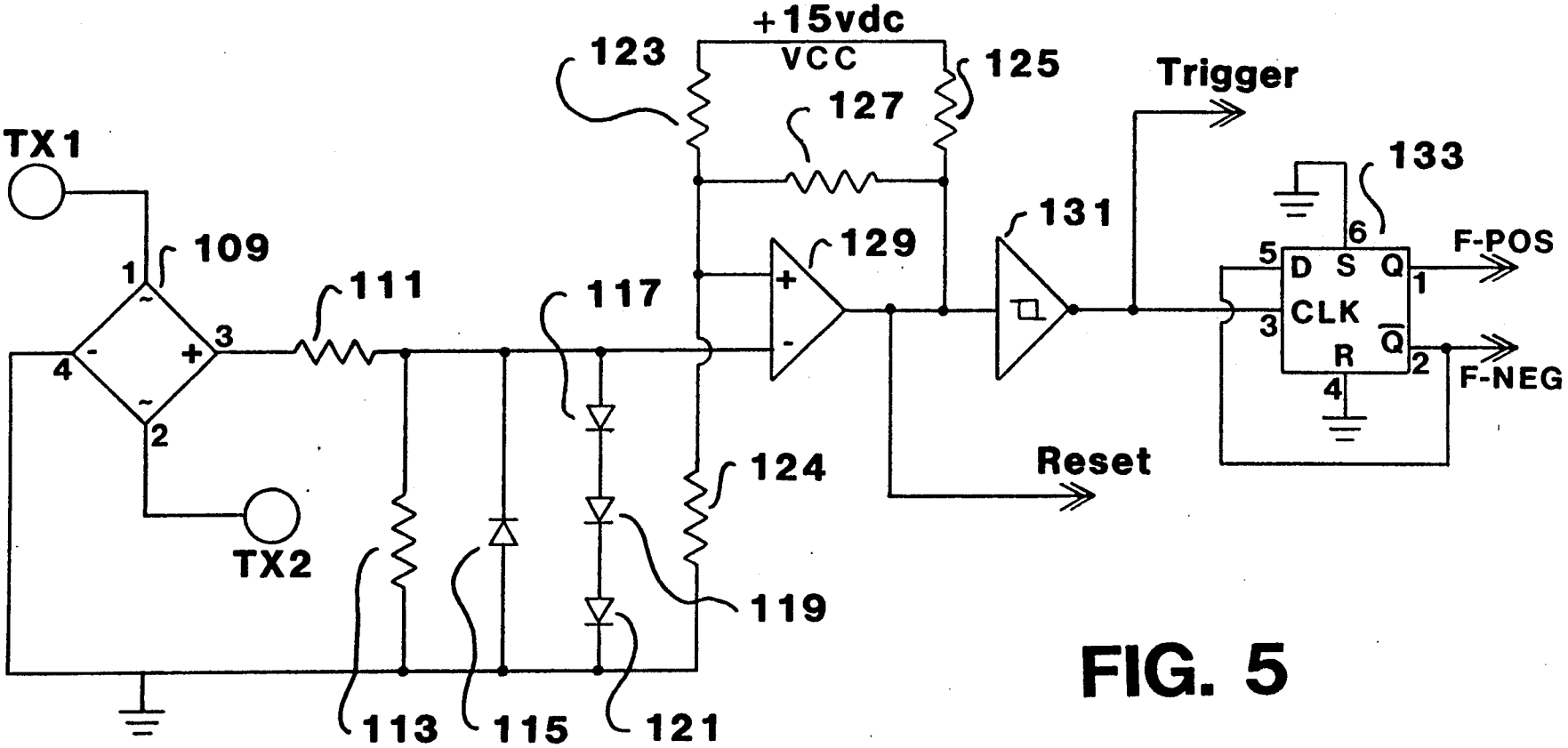
FIG. 5 is an electrical schematic of the zero crossing detector circuit of the controller.

FIG. 5 is an electrical schematic of the zero cross detection circuit of controller 43. Single phase power is transmitted to this circuit by transformer leads TX1, TX2. The single phase power signal is rectified by dip bridge 109. The resulting voltage form is passed through the voltage divider of resistors 111, 113 to the inverting input of operational amplifier 129. The inverting input is clamped to a voltage level set by diodes 117, 119, 121. Thus, the maximum voltage input to the inverting input of operational amplifier 129 is limited. The noninverting input of operational amplifier 129 is coupled to 15 volts DC (VCC) through the voltage divider of resistors 123 and 124.

Operational amplifier 129 is operated as a comparator. The voltage level at the non-inverting input is quite low, very near zero. When the voltage level at the inverting input of operational amplifier 129 falls below this minimal voltage level, the output goes low. This low signal constitutes the RESET signal depicted in FIG. 2. The RESET signal is inverted by inverter 131 to produce a TRIGGER signal. As shown in FIG. 2, the TRIGGER signal is routed to sequence circuit 63. Returning now to FIG. 5, the TRIGGER signal is fed through flip flop 133 to create F-POS and F-NEG signals. When F-POS is high, F-NEG is low, and vice versa. As shown in FIG. 2, the F-NEG and F-POS signals are fed to discrete control input circuit 55 for the generation of FIRE-POS and FIRE-NEG signals.

Figure 6:
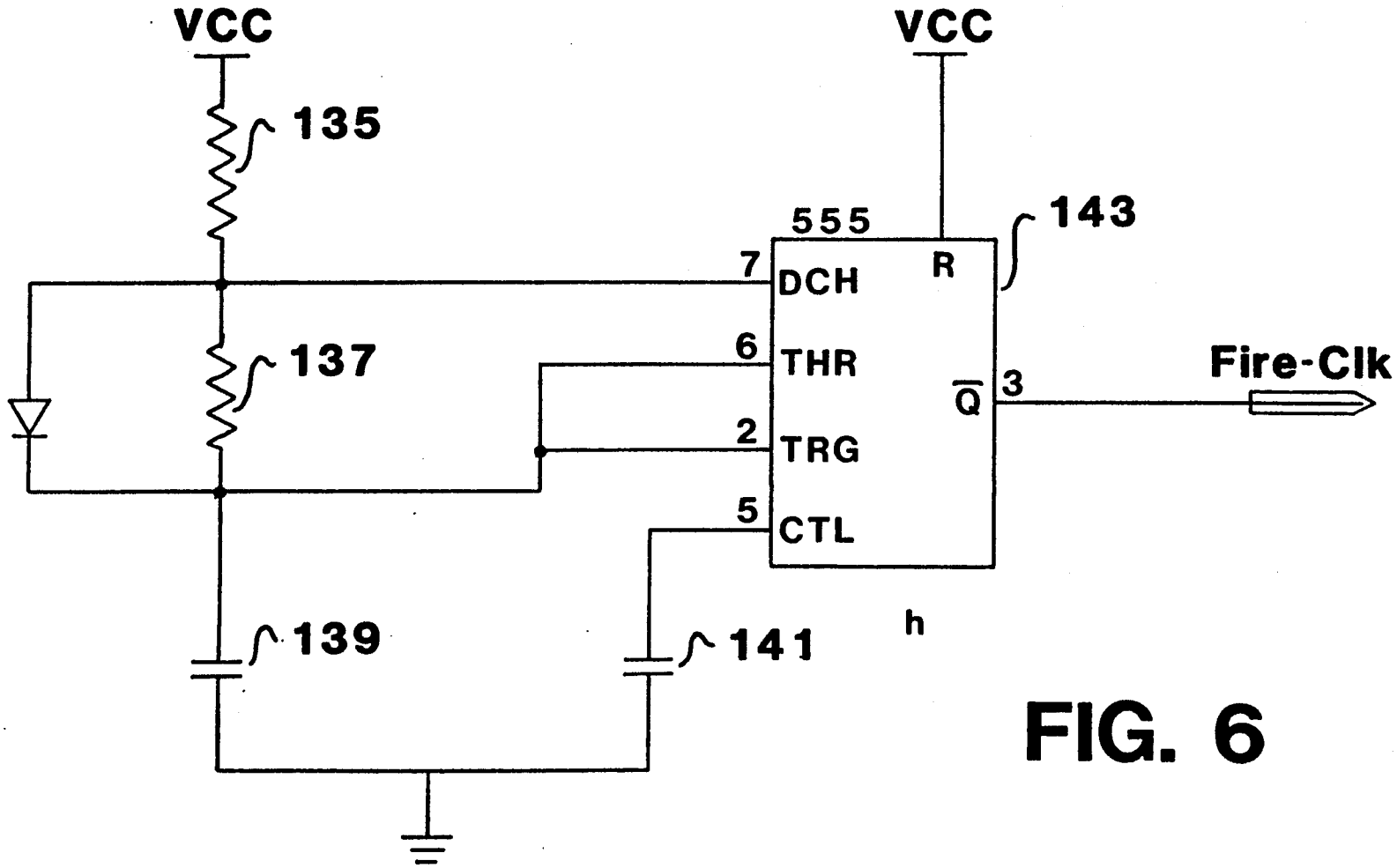
FIG. 6 is an electrical schematic of the firing clock circuit of the controller unit.

FIG. 6 is an electrical schematic of the firing clock circuit. Essentially, the firing clock circuit comprises a monostable multivibrator 143 which is operated as an oscillator. The frequency of oscillation is set by the selection of resistors 135, 137 and capacitors 139, 141. In the preferred embodiment, firing clock circuit produces a 45,000 hertz pulse signal, FIRE-CLK, which is used to drive the pulse transformer circuit 59 at a sufficiently high frequency. The FIRE-CLK signal as also used in the fire angle control circuit 57.

Figure 7:
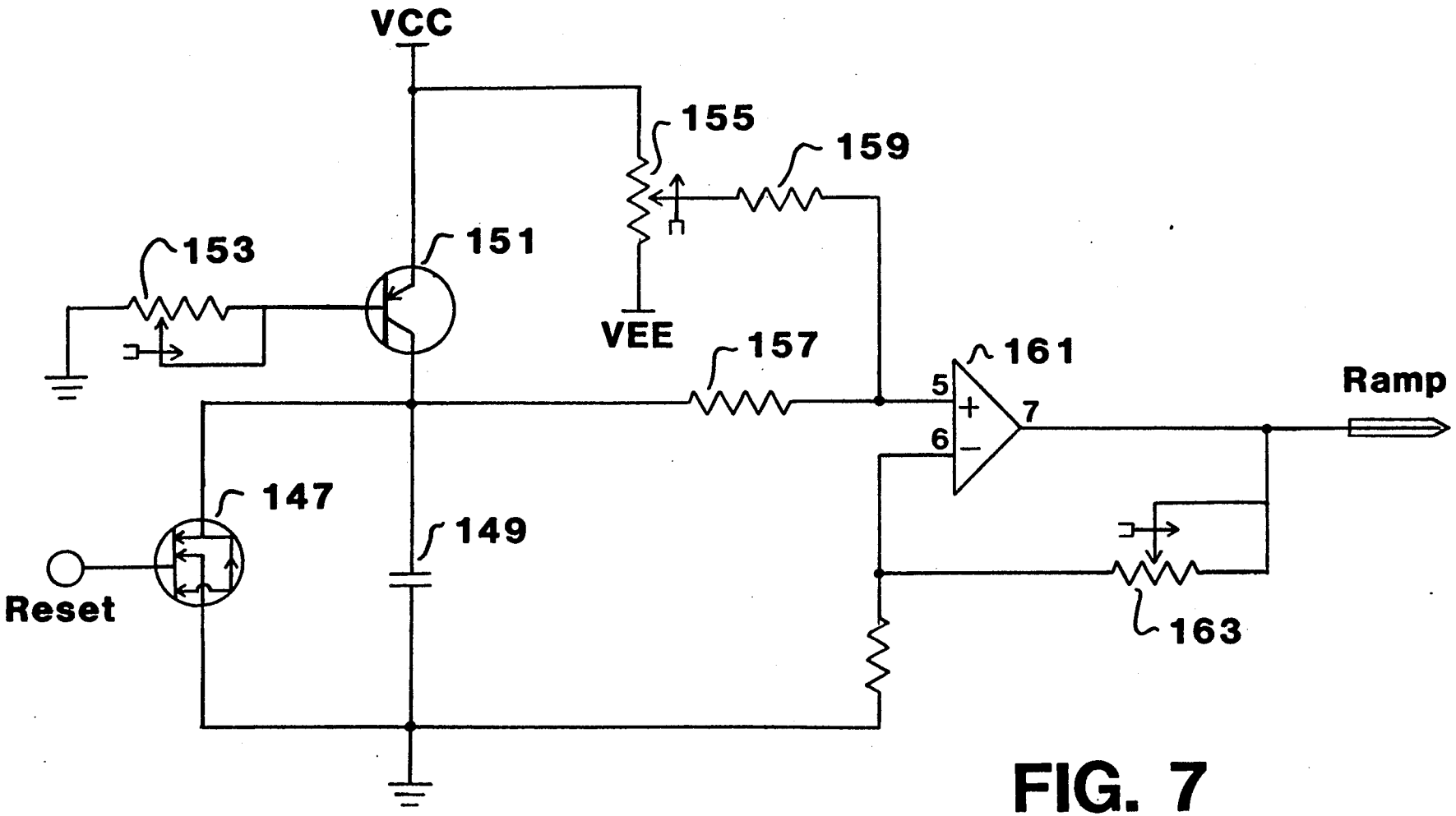
FIG. 7 is an electrical schematic of the ramp generator circuit of the controller unit.

FIG. 7 is an electrical schematic of the ramp generator circuit 51 of FIG. 2. In this circuit, field effect transistor 147 is triggered by RESET signal to drain capacitor 149 of its accumulated charge, causing the ramp to go to zero. Capacitor 149 is then recharged through the constant current source provided by transistor 151. The resistance values of variable resistors 153, 155 and resistors 159 and 157 serve to set the voltage level to which capacitor 149 may be charged. Resistor 157 also serves as a current limiting resistor, and is connected to the noninverting input of operational amplifier 161. The inverting input of operational amplifier 161 is connected to ground. Operational amplifier 161 serves two purposes: first, as a buffer; second, to control the gain, and hence the slope of the ramp. Ramp generator circuit 51 produces a sawtooth output synchronized with the zero crossing signal from zero crossing detection circuit 49. This sawtooth signal is identified as "RAMP."

Figure 8:
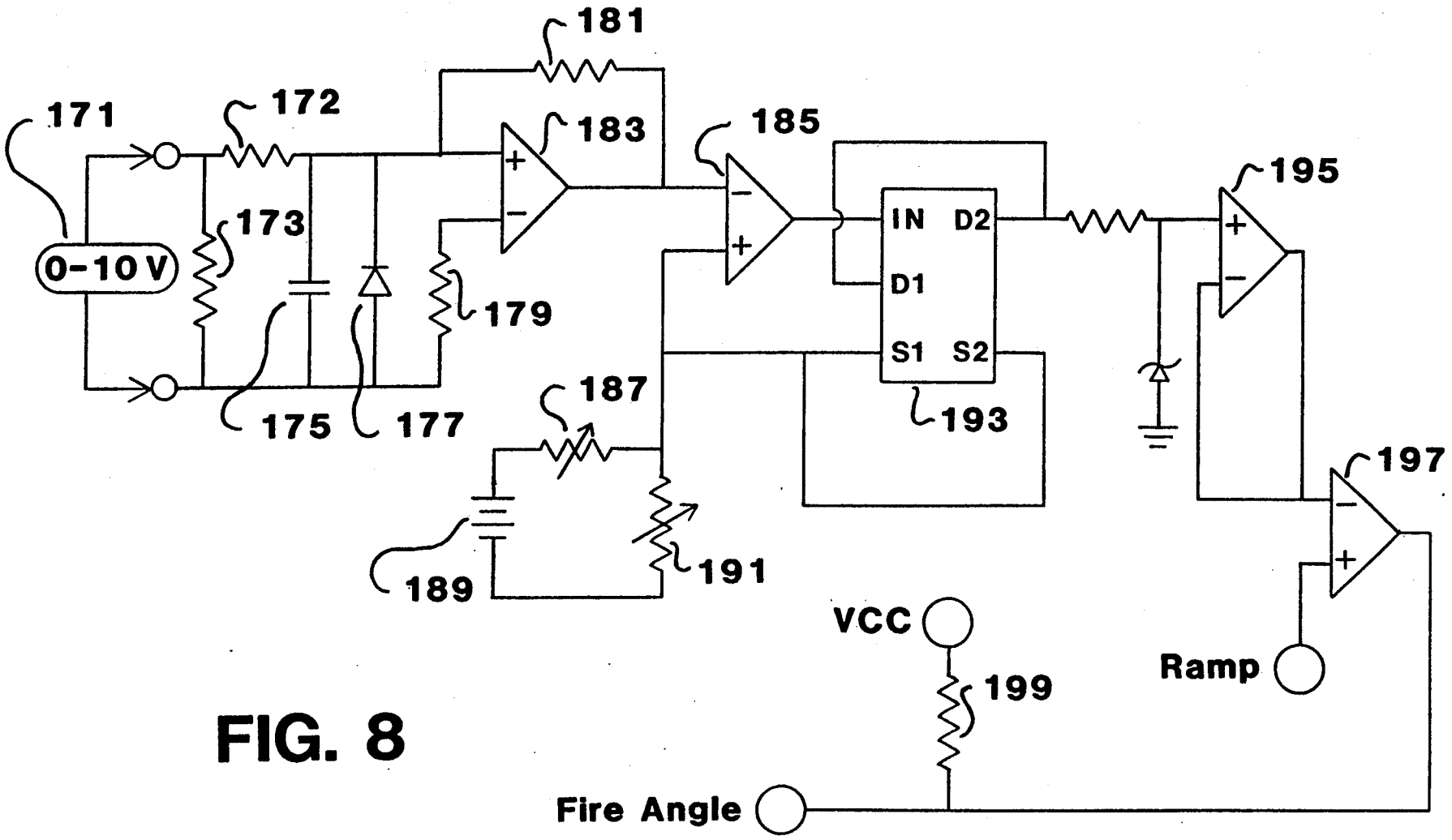
FIG. 8 is an electrical schematic of the fire angle control circuit of the controller unit.

FIG. 8 is an electrical schematic of the fire angle control circuit 57 of FIG. 2. Variable Voltage source 171 allows the operator to select an input DC voltage between zero and ten volts, which sets a corresponding FIRE ANGLE signal. For example, a maximum setting of Variable voltage control 171 will set a maximum FIRING ANGLE as an output. Resistor 173 is for loading the input source. Resistor 172 and capacitor 175 comprise a filter. Diode 177 is to clamp the input voltage between 12 volts DC and about 31 0.6 volts DC. The selected voltage is applied to the noninverting input of operational amplifier 183. In the preferred embodiment, operational amplifier 183 serves merely to buffer the signal. The output of operational amplifier 183 is directed to the inverting input of operational amplifier 185, which is operating as a comparator. The noninverting input of operational amplifier 185 is connected to battery 189 through the voltage divider of resistors 187, and 191. Resistor 191 is a variable resistor, which allows the operator to preset a minimum firing angle below Which controller 43 will not fire.

If the voltage level selected by the operator by variable Voltage control 171 is above this minimum voltage level, comparator 185 will go low. Of course, the voltage set by the operator at variable voltage control 171 corresponds to the desired phase angle. When the output of operational amplifier 185 goes low, then the open collector output of operational amplifier 185 is turned on and its output is pulled low. This causes switch one of relay 193 to be closed and switch two of relay 193 to be opened. This gates the phase signal through buffer 195 to comparator 197.

If the phase angle signal selected by the operator is lower than the minimum firing angle, comparator 185 fires and toggles the switches, gating the minimum phase angle signal to the output buffer 197. In summary, the FIRE ANGLE control circuit 57 operates by producing a FIRE ANGLE signal corresponding to a DC voltage level selected by the operator. The FIRE ANGLE signal is synchronized with the zero crossing of the power signal by comparison to the RAMP signal.

Figure 9:
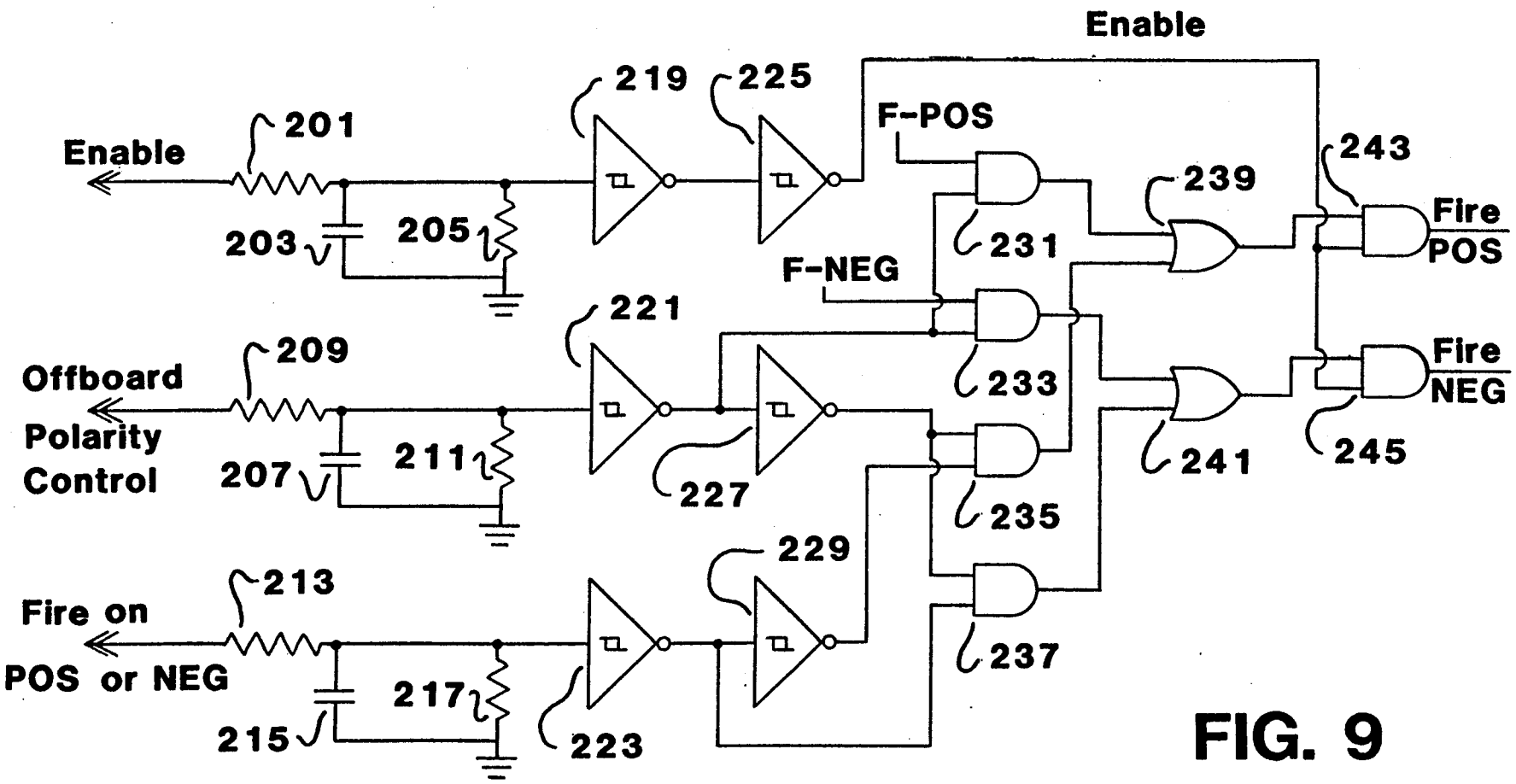
FIG. 9 is an electrical schematic of the discrete control input circuit of the controller unit.

FIG. 9 is an electrical schematic of discrete control input circuit 55 of FIG. 2. As discussed above, discrete control input circuit 55 receives the F-POS and F-NEG signals from zero crossing detection circuit 49, and the ENABLE, OFF BOARD POLARITY CONTROL, and FIRE-ON-POS-OR-NEG signals from sequence circuit 63. These signals are combined in logic gates to produce two signals: FIRE-POS and FIRE-NEG. In this circuit, the ENABLE signal is filtered through resistor 201, capacitor 203 and resistor 205, and is then routed through inverters 219 and 225. The ENABLE signal is then routed to the input of "and" gates 243, and 245. The OFF BOARD POLARITY CONTROL signal is filtered through resistor 209, capacitor 207, and resistor 211, then routed through inverters 221, and 227. It is then fed into one input of "and" gates 235 and 237. The FIRE-ON-POS-OR-NEG signal is likewise filtered by resistor 213, capacitor 215, and resistor 217, and then routed through inverters 223, 229.

The inverted OFF BOARD POLARITY CONTROL signal is "anded" with F-NEG at "and" gate 233, and is "anded" with the F-POS signal at "and" gate 231. The noninverted OFF BOARD POLARITY CONTROL signal is "anded" at gate 235 with the noninverted FIRE-ON-POS-OR-NEG signal. At gate 237, the inverted FIRE-ON-POS-OR-NEG signal is "anded" with the noninverted OFF BOARD POLARITY CONTROL signal. The output of "and" gates 231 and 235 are "ored" at "or" gate 239. Likewise, the output of "and" gates 233 and 237 are "ored" at "or" gate 241. The output of "or" gate 239 is "anded" with the ENABLE signal at "and" gate 243. The output of "or" gate 241 is "anded" with the ENABLE signal at "and" gate 245. As discussed above, the output of "and" gate 243 is F-POS and the output of "and" gate 245 is F-NEG.

In operation, if the ENABLE signal is low, the FIRE-POS and FIRE-NEG lines are low, and no conduction through the silicon controlled rectifiers is possible. If, on the other hand, ENABLE is high, conduction is possible. The OFF BOARD POLARITY CONTROL signal determines whether the output of silicon control rectifier circuit 61 is controlled by sequence circuit 63. If the OFF BOARD POLARITY CONTROL signal is high, the frequency and duty cycle of the resulting output signal may be controlled by sequence circuit 63. The FIRE-ON-POS-OR-NEG signal determines whether positive or negative output pulses are produced. If the FIRE-ON-POS-OR-NEG signal is high, positive output pulses are produced. In contrast, if the FIRE-ON-POS-OR-NEG signal is low, negative output pulses are produced.

Figure 10:
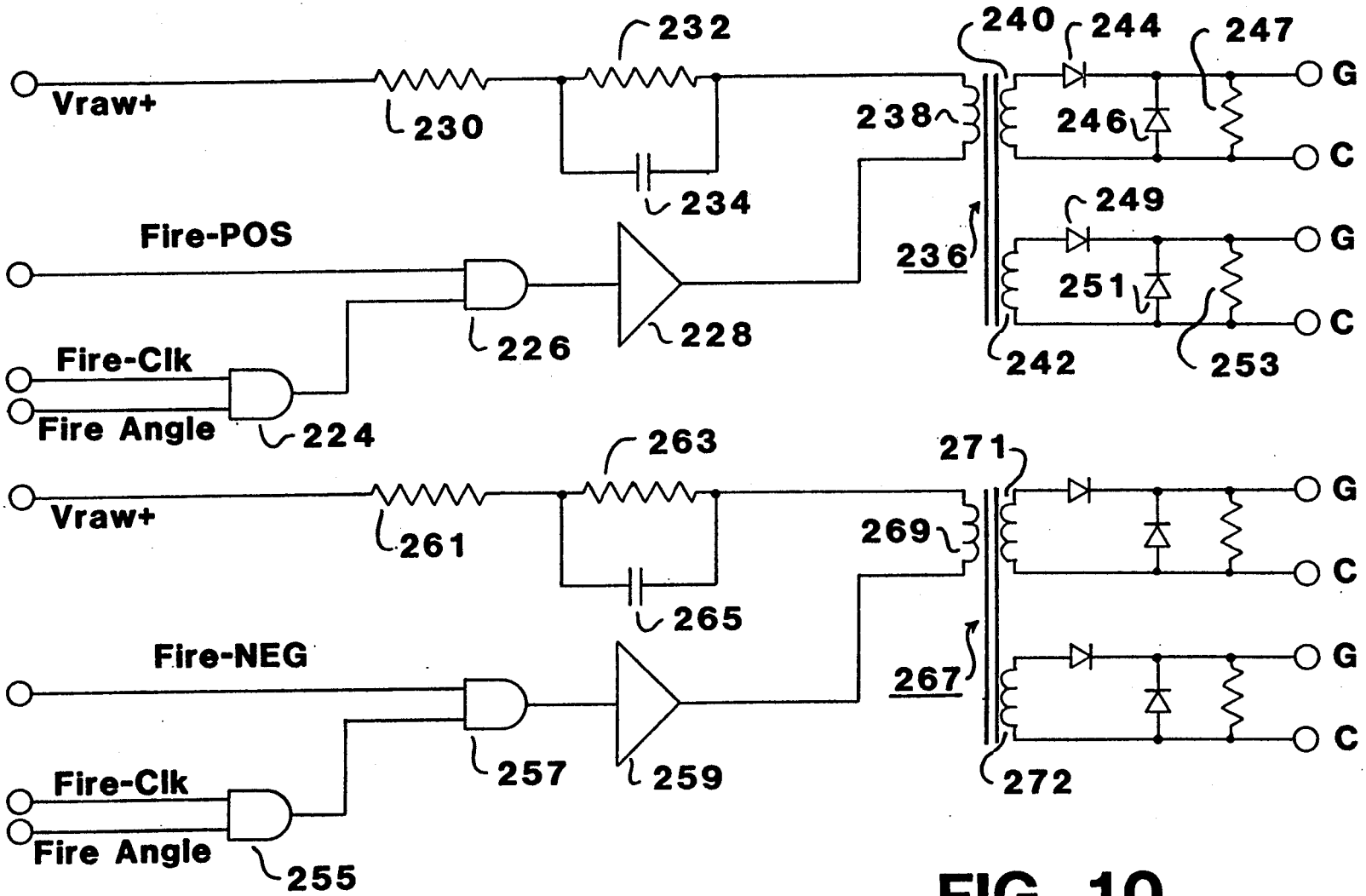
FIG. 10 is an electrical schematic of the pulse transformer circuit of the controller unit.

FIG. 10 is an electrical schematic of the pulse transformer circuit 59 of FIG. 2. The circuit is used to drive the silicon controlled rectifiers of SCR circuit 61. Pulse transformer circuit 59 actually consists of two sub-circuits which are in many respects identical. One subcircuit produces positive power pulses, and the other circuit produces negative power pulses. Positive pulses are produced when the FIRE-POS, FIRE-CLK, and FIRE ANGLE signals are all high. "And" gates 224 and 226 operate to "and" these three signals. If all signals are high, the output of "and" gate 226 is high, causing open collector output driver 228 to switch on and allow VRAW+to drive current through resistors 230, 232 and capacitor 234, and through primary coil 238 of transformer 236. The VRAW+signal is picked up by the two secondary coils 240, 242. The signal at secondary coil 240 is routed through diodes 244, 246, and resistor 247 to act on the gate and cathode of one silicon controlled rectifier. The signal picked up at secondary coil 242 is routed through diode 249, diode 251, and resistor 253 to act on gate and cathode of another silicon controlled rectifier.

The second subcircuit of pulse transformer circuit 59 is identical with one exception. In this circuit, a combination of positive signals from FIRE-NEG, FIRE-CLK, and FIRE ANGLE produce negative power signals from SCR circuit 61. The FIRE-CLK and FIRE ANGLE signals are "anded" together at "and" gate 255. The output of "and" gate 255 is "anded" with FIRE-NEG at "and" gate 257. If "and" gate 257 goes high, open collector output drive 259 is actuated to allow VRAW+to direct current through resistors 261, 263, and capacitor 265. This voltage is transferred from primary coil 269 of transformer 267 where it is picked up by two secondary coils: secondary 271 and secondary 272. The voltage signal is then impressed across the gate and cathode terminals of two silicon controlled rectifiers which serve to gate negative power signals.

Figure 11:
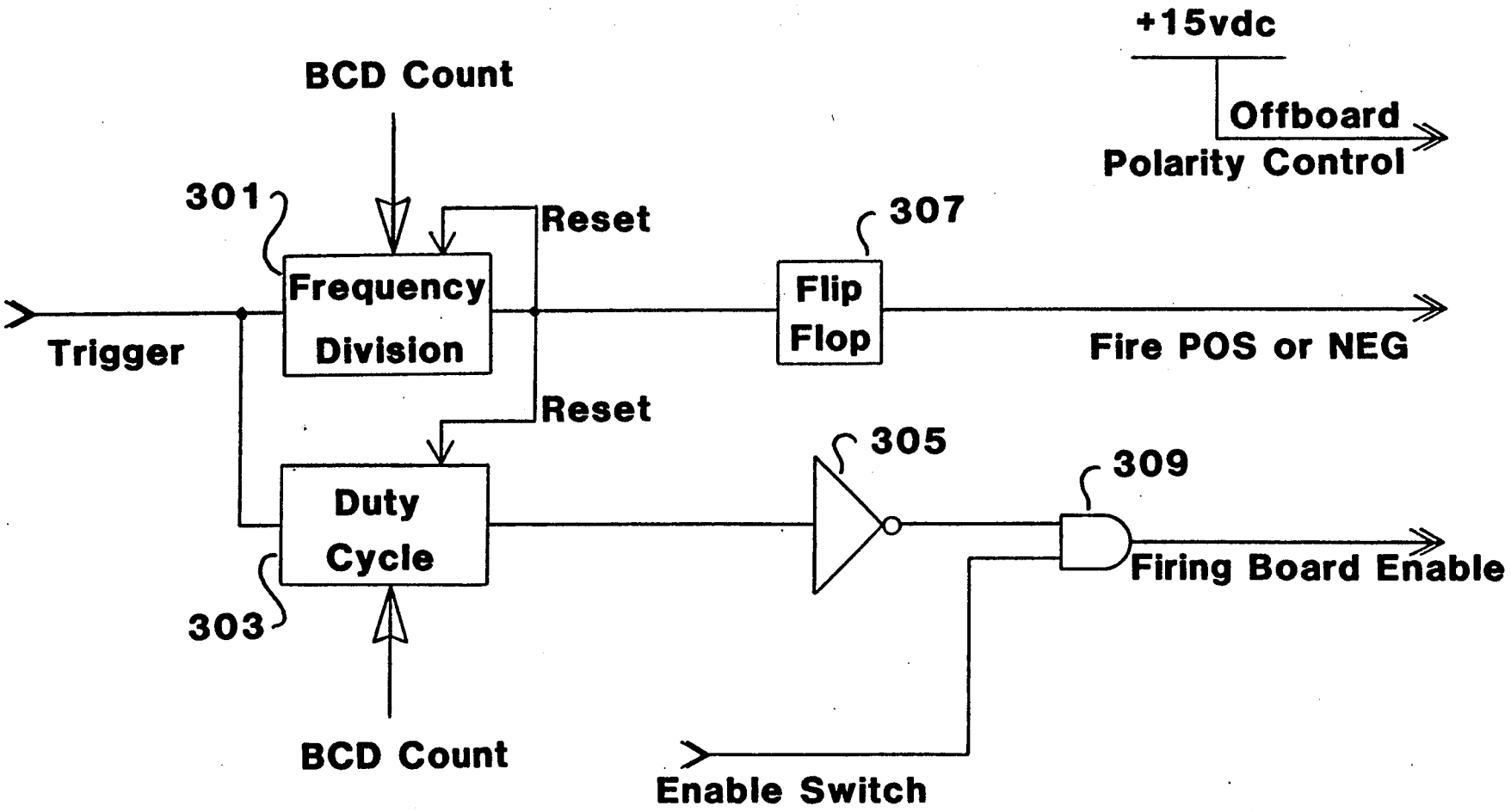
FIG. 11 is an electrical schematic of the sequence board of the controller unit.

FIG. 11 is a simplified electrical schematic of sequence circuit 63 of FIG. 2. The TRIGGER signal from zero crossing detection circuit 49 is provided as an input to a counter for frequency division 301 and a counter for duty cycle division 303. A binary coded decimal count (BCD count) may be set for each counter 301, 303 by operator input. Specifically, these may be set by a thumb wheel switch. The TRIGGER signal provides 120 trigger pulses for the 60 hertz power signal, so each half cycle is counted. The operator may select an integer between one and ten as the BCD count input, to divide the 120 hertz TRIGGER signal by an integer between one and ten. The resulting output of counter 301 is a signal having a frequency in the amount of 120 hertz divided by the BCD count integer. For example, a BCD count setting of ten will result in an output from counter 301 of a 12 hertz pulse signal. The output of counter 301 is fed through flip flop 307, so the resulting FIRE-ON-POS-OR-NEG signal alternates in polarity, first high then low then high again. Accordingly, the frequency of the output signal of controller 43 may be set manually by the operator to frequencies between six and sixty hertz.

The duty cycle of the resulting output signal of controller 43 may be set by sequence circuit 63. Counter for duty cycle 303 is similar to counter 301. TRIGGER signals are input into the counter. The operator selects an integer BCD count which produces an output of a desired frequency. The output pulse train is directed through inverter 305, and then "anded" with ENABLE switch input at "and" gate 309. In this configuration, the firing board ENABLE signal will go negative for the duration of one trigger pulse at a selected frequency, acting to blank out the conduction of the power signal.

Figure 12A:
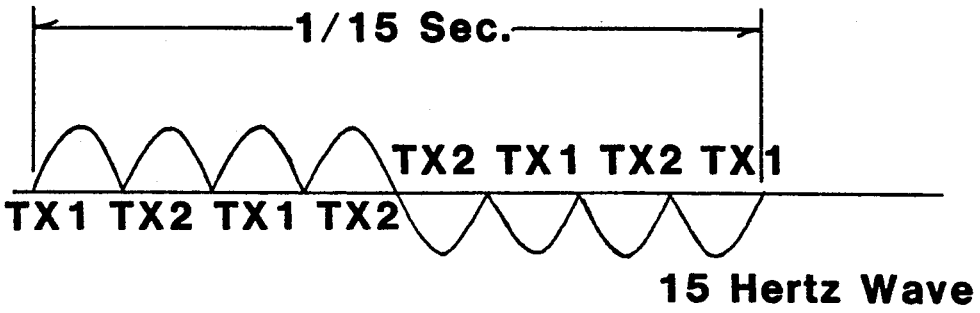
FIGS. 12A, B, and C depict examples of variations in frequency and duty cycle in the output signal which are configurable with the controller unit.

FIGS. 12A, B, and C depict the types of waveforms which can be produced by controller 43 using sequence circuit 63 to alter the effective frequency and duty cycle of the output. The waveforms depicted in FIGS. 12A, B, and c are those produced with a zero FIRE ANGLE signal, as a result of a zero setting at voltage control 58 by the operator. Of course, in operation, a transient component is desired in the power signal directed down the wellbore 11. However, for purposes of illustration only, signals with no transient content are depicted in these figures.

Controller 43 operates to selectively gate the conduction of silicon controlled rectifier 75, 77, 79, and 81 of FIG. 3. The gating may be controlled by sequence circuit 63 to combine positive and negative portions of sinusoidal waveforms 70, 72. In FIG. 12A, the positive and negative portions of sinusoidal waveforms 70, 72 are combined to produce a power signal having an effective frequency of 15 hertz. This can be done since the waveforms 70, 72 are 90° out of phase. The positive and negative half cycles of FIG. 12A are marked with the lettering "TX1" and "TX2" to indicate the origin of each portion. As is demonstrated by FIG. 12A, SCR circuit 61 operates by switching selected positive and negative half waveforms from the TX1, and TX2 lines.

Figure 12B:
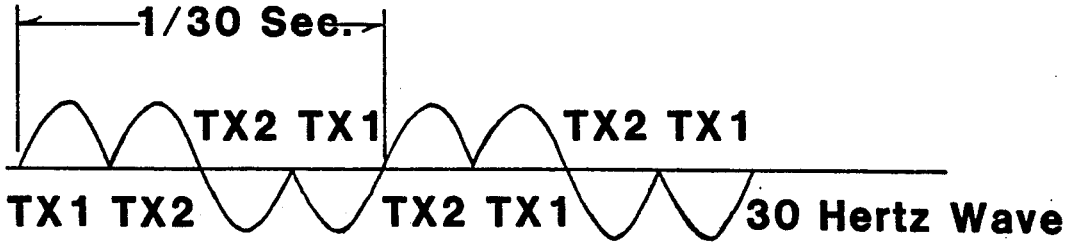

FIG. 12B depicts an output waveform having an effective frequency of 30 hertz. Again, each positive and half waveform is designated as originating from either TX1, or TX2.

Figure 12C:
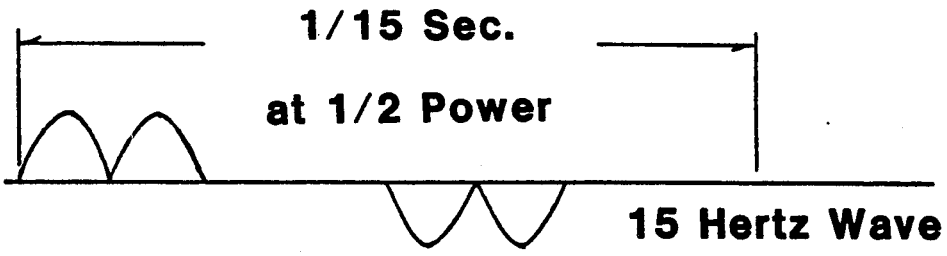

FIG. 12C is a waveform having a 30 hertz frequency, like that of FIG. 12B, but which is operating at half power. As discussed above in connection with FIG. 11, the operator may select a duty cycle for the output signal by providing a BCD count to counter 303. The output of counter 303 is inverted at inverter 305, and "anded" at "and" gate 309 with a signal from the ENABLE switch. Thus, the duty cycle of the output waveform is regulated by selectively disabling the SCR circuit 61.

Figure 13A:
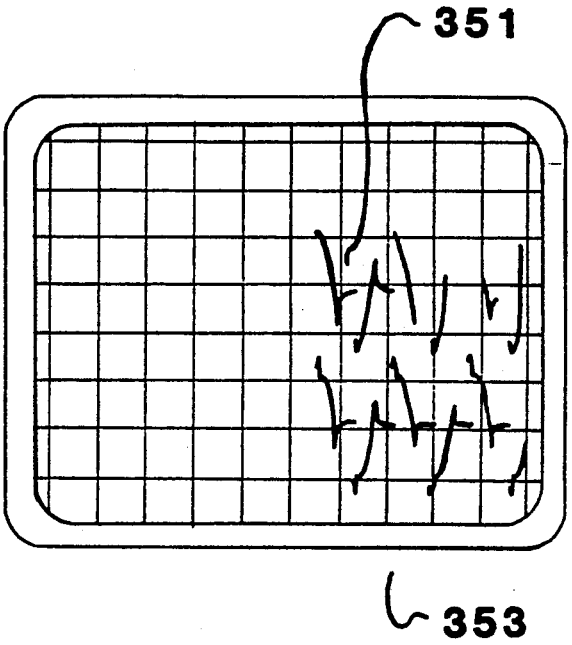
FIGS. 13A and B depict voltage and current signals produced by the controller unit which have high transient content.
Figure 13B:
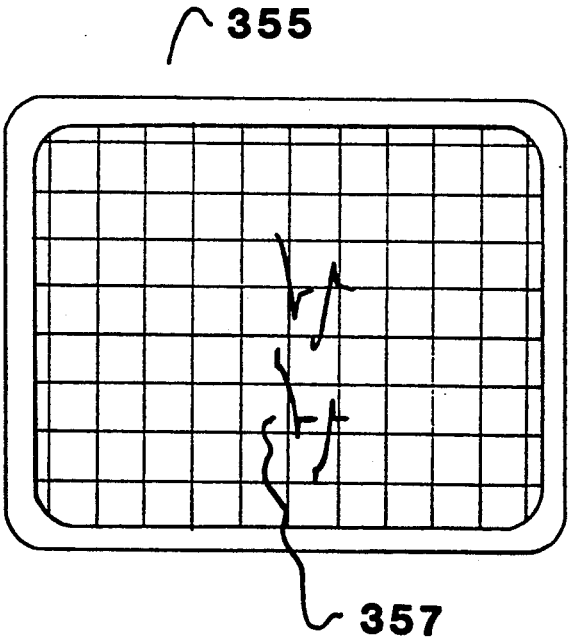

FIGS. 13A and B depict voltage and current signals produced by the controller unit which have high transient content. These figures depict a 60 hertz full-duty signal, with a 90° FIRING ANGLE, (phase angle). As discussed above, the phase angle is selectable by the operator. Waveform 351 represents the voltage applied to the tubing 25 and casing 21 of wellbore 11. Waveform 353 represents the current sensed in the wellbore. FIG. 13B depicts a single voltage waveform 355, and current waveform 357. Note the high transient content of these waveforms.

Figure 14A:
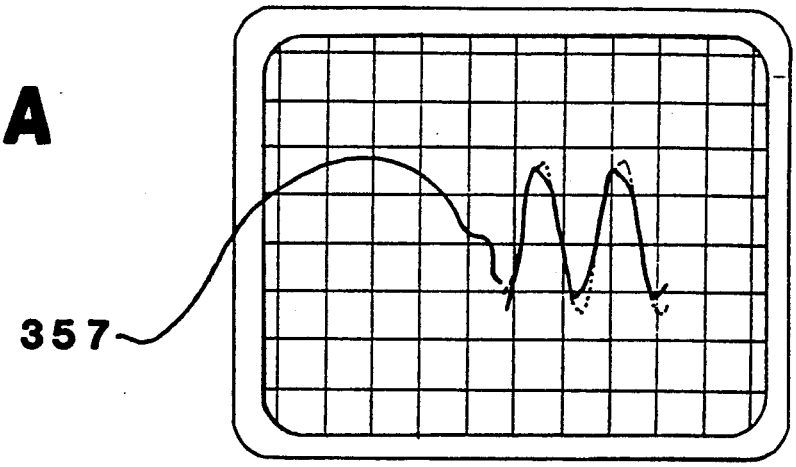
FIGS. 14A, B, and C depict positive output pulses with high transient content.
Figure 14B:
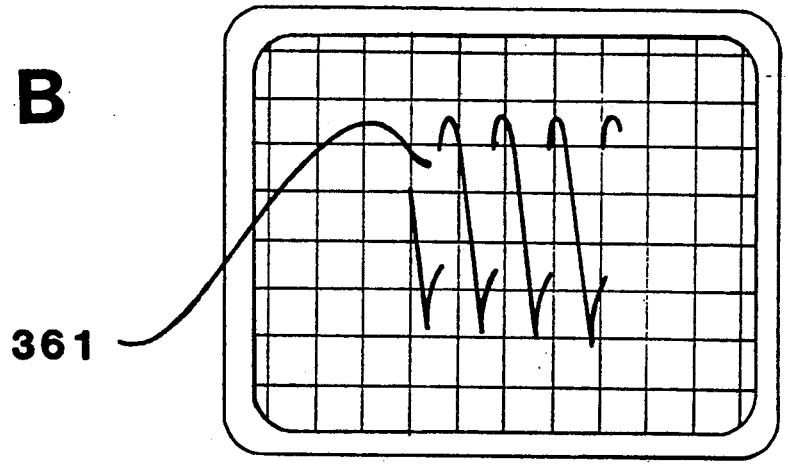
Figure 14C:
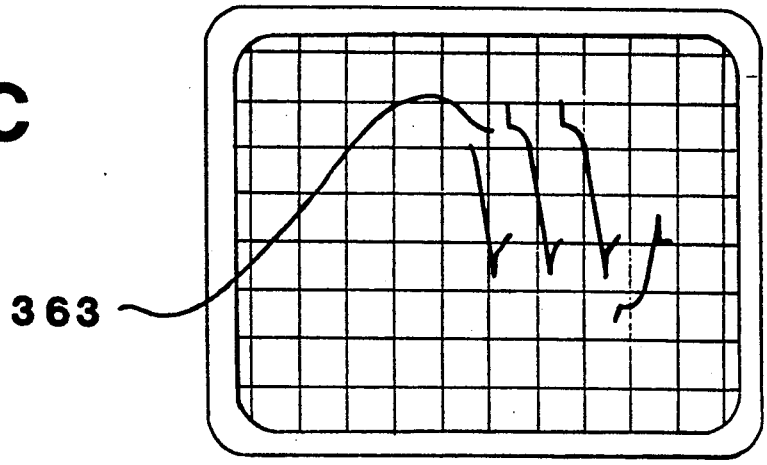

FIGS. 14A, B, and C depict positive output pulses with high transient content. FIG. 14A depicts a voltage waveform of positive pulses switched at a selected phase angle. The voltage waveforms 361, and 363 of FIGS. 14B and C depict waveforms produced at different phase angle settings. Note that the transient content of the signal can be adjusted by the phase angle control.

Experimental field testing has Verified that induced mechanical vibration of the casing and tubing indeed enhances production of petroleum 16 from wellbore 11. Experiments have determined that when power signals with high transient content are directed into the wellbore circuit, no appreciable heating of the production string and production fluids occurs. Of course, heating of the production string and production fluids occurs when ordinary 60 hertz power signals (without transient content) are passed through the wellbore circuit. Experiments on test beds reveal that standard 60 hertz power signals (without transient content) do produce heating in both the tubing and the load. However, with a transient laden power signal, no appreciable heating of the tubing occurred, and heating of the load occurred only if an electrolytic solution was present, such as salt water. Mathematical and computer modeling of the electrical stimulation of wellbore 11 revealed that no net heating of the petroleum 16, and tubing 21 occurred when transient-filled power signals were directed into wellbore 11. However, energy was dissipated, presumably due to induced mechanical vibration of tubing 25 and casing 21.

In addition, test bed experiments revealed that mechanical vibration of a tubing string could be induced by passing a power signal, with high transient content, through the tubing.

These and other tests indicate that a mechanical vibration could indeed be generated in the tubing 25 and casing 21 to enhance the production of petroleum.

Figure 15:
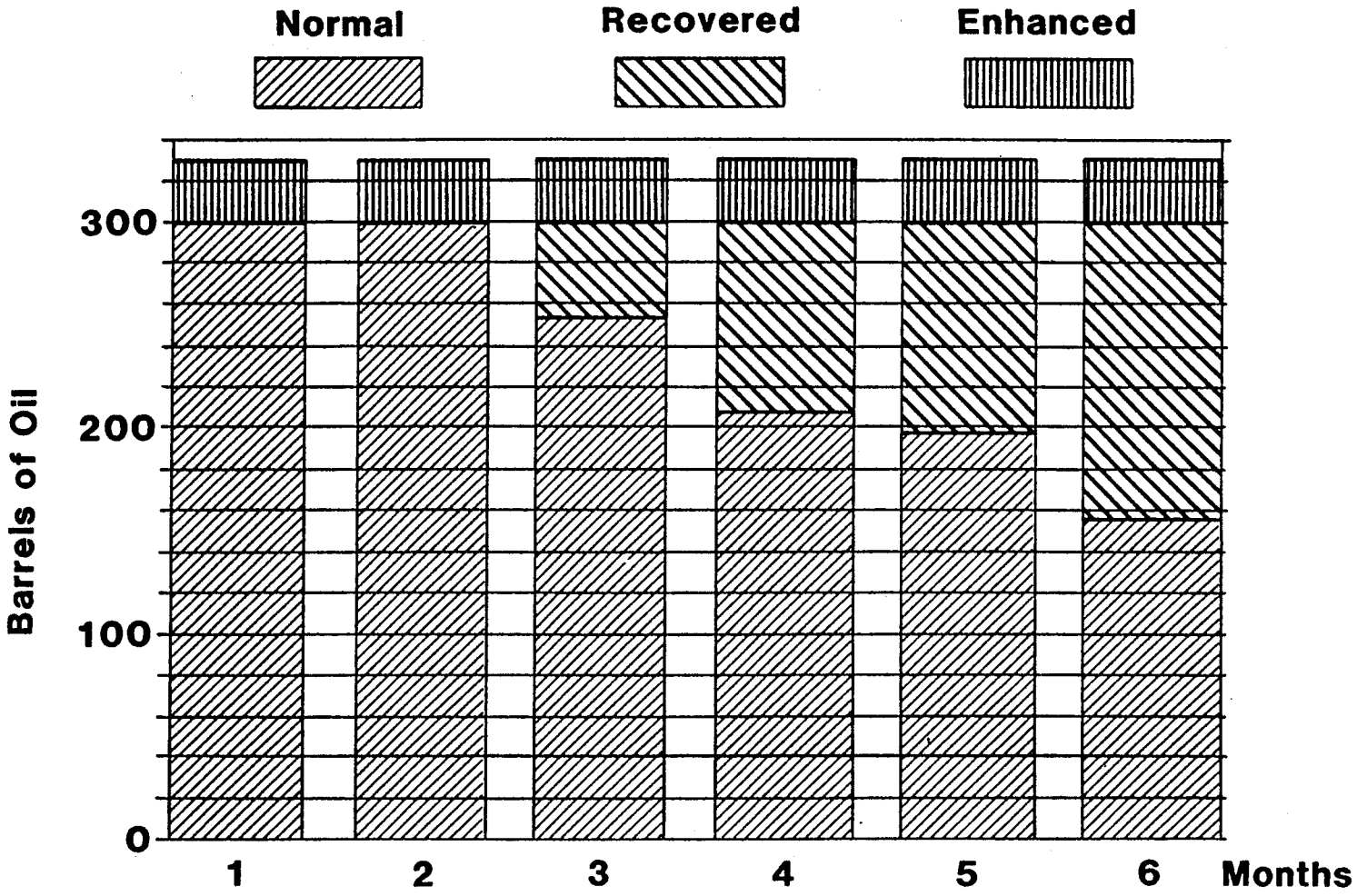
FIG. 15 depicts in graphic form the enhanced recovery produced by the present invention.

FIG. 15 depicts the enhanced production from one test well over a period of six months. This particular well ordinarily required chemical treatment to enhance production approximately every six months. Once the chemical treatment was completed, production would decline to an unacceptable point. When a transient-laden power signal was continuously conducted through the tubing and casing of the wellbore, enhanced production was achieved and maintained over an entire six month period. In FIG. 15, the vertical axis indicates barrels of oil, and the horizontal axis indicates time. Normal, recovered, and enhanced production are indicated by the bar graphs.

It is possible that production can be optimized by matching the frequency of the transient-filled power signal with the naturally occurring resonant frequency of the formation of interest. Controller 43 allows the operator to select a frequency and duty cycle for the transient-filled power signal. More importantly, controller 43 allows the operator to select the amount of transient content for the power signal.

The method of enhanced production of the present invention has many advantages over existing and proposed enhanced recovery techniques. First, enhanced recovery may be sustained for long periods of time, without requiring periodic reapplication of the enhanced recovery technique, such as with chemically induced enhanced recovery. This stands in sharp contrast with known methods of chemically stimulating enhanced production, which require periodic reapplication.

Second, the method of the present invention is a cost efficient means for enhancing production. The amount of energy expended in the mechanical vibration of the tubing and casing is small compared to the energy expenditures of competing enhancing recovery techniques. For example, electrical stimulation of the formation frequently requires huge amounts of power on a continuous basis.

Third, the method of mechanically stimulating enhanced production has significant advantages over the known methods of enhancing production by dynamiting a wellbore. The present method is nondestructive of the wellbore. In addition, it may be employed in wells with casing, whereas the dynamiting process for enhancing is limited to uncased boreholes. The present method is a continuous means for enhancing production, as opposed to the intermittent means of periodically dynamiting a wellbore to shock the formation, and enhance production.

Fourth, the enhanced recovery technique of the present invention may be used in combination with other enhanced recovery techniques. For example, steam injection may be combined within the process of the present invention to achieve greater enhanced recovery. For an alternate example, the method of heating the formation with currents may be combined with the method of the present invention to perhaps achieve greater enhanced recovery.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. A method of enhancing production of petroleum from a petroleum bearing formation having at least one tubular member suspended therein, comprising:

including mechanical vibration in said at least one tubular member for translation into said formation to enhance petroleum production by passing an electrical signal directly through said at least one tubular member; and adjusting said mechanical vibration of said at least one tubular member to optimize production of petroleum from said information.

2. A method of enhancing production of petroleum from a petroleum bearing formation according to claim 1, wherein mechanical vibration is sustained substantially continuously in said at least one tubular member during production.

3. A method of enhancing production of petroleum from a petroleum bearing formation according to claim 1, wherein mechanical vibration is induced in said at least one tubular member by passing an electrical signal which includes transient components through said at least one tubular member.

4. A method of enhancing production of petroleum from a petroleum bearing formation according to claim 1, wherein said electrical signal comprises a switched power signal which is passed directly through said at least one tubular member.

5. A method of enhancing production of petroleum from a petroleum bearing formation according to claim 1, wherein mechanical vibration is induced in said at least one tubular member by passing a sinusoidal power signal switched at a selected phase delay through said at least one tubular member.

6. A method of enhancing production of petroleum from a petroleum bearing formation according to claim 1, wherein mechanical vibration of said at least one tubular member is adjusted by altering transient content of said electrical signal used to induce mechanical vibration.

7. A method of enhancing production of petroleum from a petroleum bearing formation according to claim 1, wherein mechanical vibration of said at least one tubular member is adjusted by adjustment in frequency of said electrical signal used to induce mechanical vibration.

8. A method of enhancing production of petroleum from a petroleum bearing formation according to claim 1, wherein mechanical vibration of said at least one tubular member is adjusted by adjustment in duty cycle of said electrical signal used to induce mechanical vibration.

9. A method of enhancing production of petroleum from a petroleum bearing formation through a production tubing composed of a tubing material suspended in a wellbore extending into the formation and lined by a tubular casing composed of a casing material, comprising:

inducing mechanical vibration in said tubing and casing by passing an electric current directly through at least a portion of the material of which said tubing and casing are composed, for translation into said petroleum bearing formation to enhance petroleum production; and adjusting said vibration of said tubing and casing to optimize production of petroleum from said formation.

10. A method of enhancing production of petroleum from a petroleum bearing formation according to claim 9, wherein mechanical vibration is sustained substantially continuously in said casing and tubing during production.

11. A method of enhancing production of petroleum from a petroleum bearing formation according to claim 9, wherein vibration in said tubing and casing is induced by passing an electric current which includes transient components through said tubing and casing.

12. A method of enhancing production of petroleum from a petroleum bearing formation according to claim 9, wherein mechanical vibration is induced in said casing by passing a switched power signal through said tubing and casing.

13. A method of enhancing production of petroleum from a petroleum bearing formation according to claim 9, wherein mechanical vibration is induced in said tubing and casing by passing a sinusoidal electrical power signal switched at a selected phase delay, through said tubing and casing.

14. A method of enhancing production of petroleum from a petroleum bearing formation according to claim 9, wherein mechanical vibration of said tubing and casing is adjusted by altering transient content of said electric current used to induce mechanical vibration in said tubing and casing.

15. A method of enhancing production of petroleum from a petroleum bearing formation according to claim 9, wherein mechanical vibration of said tubing and casing is adjusted by adjustment in frequency of said electric current used to induce mechanical vibration in said tubing and casing.

16. A method of enhancing production of petroleum from a petroleum bearing formation according to claim 9, wherein mechanical vibration of said tubing and casing is adjusted by adjustment in duty cycle of said electric current used to induce mechanical vibration in said tubing and casing.

17. A method of enhancing production of petroleum from a petroleum bearing formation through an electrically conductive production tubing suspended in a wellbore extending into said formation and lined by an electrically conductive tubular casing, comprising:

providing a power signal;

completing an electrical circuit path, including said production tubing and said casing as circuit current paths;

modifying said power signal by creating transients in it;

electrically coupling said modified power signal to said electrical circuit; and electrically inducing mechanical vibration in said casing and production tubing with said modified power signal, to substantially continuously mechanically vibrate said petroleum bearing formation and enhance a petroleum production therefrom.

18. A method of enhancing production of petroleum from a petroleum bearing formation according to claim 17, further comprising:

adjusting said modified power signal to optimize production of petroleum from said formation.

19. A method of enhancing production of petroleum from a petroleum bearing formation according to claim 17, further comprising:

adjusting said modified power signal by adjusting its transient content to optimize production of petroleum from said formation.

20. A method of enhancing production of petroleum from a petroleum bearing formation according to claim 17, further comprising:

adjusting said modified power signal by adjusting its frequency to optimize production of petroleum from said formation.

21. A method of enhancing production of petroleum from a petroleum bearing formation according to claim 17, further comprising:

adjusting said modified power signal by adjusting its duty cycle to optimize production of petroleum from said formation.

22. A method of enhancing production of petroleum from a petroleum bearing formation according to claim 17, wherein said power signal is modified by selected switching to produce transients.

23. A method of enhancing production of petroleum from a petroleum bearing formation according to claim 17, wherein said power signal is modified by switching at a selected phase delay to produce transients.

24. A method of enhancing production of petroleum from a petroleum bearing formation through an electrically conductive production tubing suspended in a wellbore extending into said formation and lined by an electrically conductive tubular casing, comprising:

providing a power signal;

completing an electrical circuit path, including at least one wellbore tubular member including at least one of said production tubing and said casing as circuit current paths;

modifying said power signal by creating transients in it;

electrically coupling said modified power signal to said electrical circuit; and electrically including mechanical vibration in said at least one wellbore tubular member with said modified power signal, to substantially continuously mechanically vibrate said petroleum bearing formation and enhance a petroleum production therefrom.

25. A method of enhancing production of petroleum from a petroleum bearing formation according to claim 24, further comprising:

adjusting said modified power signal to optimize production of petroleum from said formation.

26. A method of enhancing production of petroleum from a petroleum bearing formation according to claim 24, further comprising:

adjusting said modified power signal by adjusting its transient content to optimize production of petroleum from said formation.

27. A method of enhancing production of petroleum from a petroleum bearing formation according to claim 24, further comprising:

adjusting said modified power signal by adjusting its frequency to optimize production of petroleum from said formation.

28. A method of enhancing production of petroleum from a petroleum bearing formation according to claim 24, further comprising:

adjusting said modified power signal by adjusting its duty cycle to optimize production of petroleum from said information.

29. A method of enhancing production of petroleum from a petroleum bearing formation according to claim 24, wherein said power signal is modified by selected switching to produce transients.

30. A method of enhancing production of petroleum from a petroleum bearing formation according to claim 24, wherein said power signal is modified by switching at a selected phase delay to produce transients.

* * * * *